United States Patent [19]

Morris, Jr. et al.

[11] 4,257,808

[45] Mar. 24, 1981

[54] LOW MN ALLOY STEEL FOR CRYOGENIC SERVICE AND METHOD OF PREPARATION

[75] Inventors: John W. Morris, Jr., Berkeley, Calif.; Masakazu Niikura, Yokohama, Japan

[73] Assignee: The United States of America as represented by the United States Department of Energy, Washington, D.C.

[21] Appl. No.: 66,106

[22] Filed: Aug. 13, 1979

[51] Int. Cl.[3] ..... C22C 38/04; C21D 6/00

[52] U.S. Cl. ..... 75/123 N; 148/12 F; 148/36; 148/134; 148/143; 148/144

[58] Field of Search ..... 75/123 N; 148/3, 12 R, 148/36, 134, 143, 144, 12 F

[56] References Cited

U.S. PATENT DOCUMENTS

| | | | |
|---|---|---|---|
| Re. 28,645 | 12/1975 | Aoki et al. | 148/134 X |
| 3,388,988 | 6/1968 | Nagashima et al. | 148/12 F X |
| 4,047,979 | 9/1977 | Grange et al. | 148/12 F X |
| 4,162,158 | 7/1979 | Hwang et al. | 75/123 N X |

OTHER PUBLICATIONS

J. W. Morris, Jr. et al., "The Use of Martensite Reversion in the Design of Tough Cryogenic Steels", Proc. First Jim Internat. Symposium, May 10–12, 1976.

S. Jin et al., Metallurgical Trans. A, vol. 6A, pp. 141–149 (1975).

*Primary Examiner*—G. L. Kaplan

*Attorney, Agent, or Firm*—William S. Bernheim; Gwenetta Douglas Hill; James E. Denny

[57] ABSTRACT

A ferritic cryogenic steel which has a relatively low (about 4–6%) manganese content and which has been made suitable for use at cryogenic temperatures by a thermal cycling treatment followed by a final tempering. The steel includes 4–6% manganese, 0.02–0.06% carbon, 0.1–0.4% molybdenum and 0–3% nickel.

8 Claims, 5 Drawing Figures

| SYMBOL | 2B-TEMP | T-TEMP |
|---|---|---|
| ▲ = 2BT | 1140°C | 620°C |
| ● = 2BT | 740°C | 590°C |
| △ = 2bt | 710°C | 620°C |
| ○ = 2bt | 710°C | 590°C |

LOW MN ALLOY STEEL FOR CRYOGENIC SERVICE AND METHOD OF PREPARATION

BACKGROUND OF THE INVENTION

1. Field of the Invention

This invention relates to an alloy steel composition, in particular, a low-maganese alloy steel composition suitable for cryogenic applications and a method for preparing the composition.

2. Description of the Prior Art

Due to dwindling natural gas supplies in this and other countries there is considerable interest in containment vessels for safely transporting liquefied natural gas (LNG) by ship and other transport. Because the boiling temperature of natural gas is in the cryogenic (generally below about −80° to −100° C.) range, LNG containers must be designed to avoid breakage due to pressure and crack development over a broad temperature range. There is also the danger of a catastrophic explosion or fire, should the containment vessel fail.

At cryogenic temperatures, ordinary steel alloys lose much of their resilence and become very brittle. A denominator of the steel alloys commonly specified for structural applications at LNG and lower temperatures is a relatively high content of nickel. The nickel contributes significantly to good low temperature properties; but, is a relatively scarce metal and, thus, adds substantially to the cost. Recently, lower (5–6%) Ni steels have been introduced to reduce cost.

Storage systems for other liquefied gases, particularly nitrogen, oxygen, and liquid air, are also a significant market for cryogenic alloys. This market is different than that for LNG in that the safety standards are less stringent and a larger number of alloys compete with more emphasis placed on materials cost.

Of the common alloying elements in steels, manganese is considered the most attractive substitute for nickel. Manganese is readily available, and, thus, relatively inexpensive, and has a metallurgical similarity to nickel in its effect on the microstructures and phase relationships of iron-based alloys. Therefore, there has been considerable interest in the potential of Fe-Mn alloys for cryogenic use.

Fe-12 Mn (12% manganese) alloys have been made tough at 77° K. (−196° C.) by several methods: (1) a cold work plus tempering treatment, (2) controlled cooling through the martensite transformation, and (3) the addition of a minor amount of boron. However, although manganese is less expensive than nickel, it also adds to the cost of the steel, and, therefore, a lower manganese content would be advantageous.

STATEMENT OF THE OBJECTS

Therefore, an object of this invention is to provide an alloy steel composition suitable for cryogenic service.

Another object is that the steel composition can be formulated without nickel.

Yet another object is that the steel composition can be formulated with a low manganese content.

Other objects, advantages and novel features of the invention will become apparent to those skilled in the art upon examination of the following detailed description of a preferred embodiment of the invention and the accompanying drawings.

SUMMARY OF THE INVENTION

The present invention includes a ferritic cryogenic alloy steel of relatively low manganese content and a method of imparting the cryogenic properties to the steel. More particularly, the present alloy steel consists essentially by weight of about 4–6% manganese, 0.02–0.06% carbon, 0.1–0.4% molybdenum, and the balance, iron and impurities normally associated therewith.

The steel is characterized by a ductile-brittle transition temperature below liquid nitrogen (77° K. or −196° C.) and a Charpy V-notch impact energy $C_V$ greater than 50 ft-lb (67 joules) at liquid nitrogen temperatures. These cryogenic properties are achieved by subjecting a steel of the aforementioned composition to a thermal cycling treatment and a subsequent tempering. The carbon and molybdenum enhance the stability of retained gamma phase in the alloy and enhance the suppression of temper-embrittlement-type intergranular fracture. Further, the cryogenic properties of the steel can be improved, while adding only slightly to the cost, by addition of up to about 3% by weight nickel.

The method of imparting favorable cryogenic properties to the alloy steel is a thermal cycling treatment. The method includes forming a composition of the above description; a first heating of the composition from a temperature, which is below a characteristic temperature $A_s$, to a temperature, which is above a characteristic temperature $A_f$; a first cooling of the composition to a temperature below $A_s$; a second heating of the composition to a temperature above $A_s$ and below $A_f$; a second cooling of the composition to a temperature below $A_s$; a third heating of the composition to a temperature above $A_f$; a third cooling of the composition to a temperature below $A_s$; a fourth heating of the composition to a temperature above $A_s$ and below $A_f$; a fourth cooling of the composition to a temperature below $A_s$; and a tempering of the composition at a temperature below $A_s$.

DETAILED DESCRIPTION

The thermal cycling treatment results in an ultra-fine grain structure. This treatment is essentially a repeated alternation of austenitization and (alpha+gamma) two phase decomposition. The type of thermal cycling treatment employed here is described in detail in "The Use of Martensite Reversion in the Design of Tough Ferritic Cryogenic Steels" J. W. Morris, Jr., et al, Proceedings of the First JIM International Symposiom on "New Aspects of Martensitic Transformation", May 10–12, 1976, The Japan Institute of Metals, Sendai, Japan. This type of thermal cycling treatment is also described in "Grain Refinement Through Thermal Cycling in an Fe-Ni-Ti Cryogenic Alloy" S. Jin, et al, Metallurgical Transactions A, Vol. 6A (1975), pp. 141-149.

The thermal cycling treatment includes alternate anneals of about one hour in between which the material is water-quenched to a temperature below $A_s$ and perferably to room temperature (air cooling should be suitable, but slower). In most cases, the anneal can be shortened to as little as 30 minutes or lengthened to as long as 2 hours without problems. In the water quench, the temperature of the material is lowered sufficiently to stabilize the structure, preferably to near ambient. A suitable cycle of anneals and quenches is shown graphically in FIG. 1, where the successive steps are labelled 1A, 1B, 2A, 2B, and T.

Figure 1:
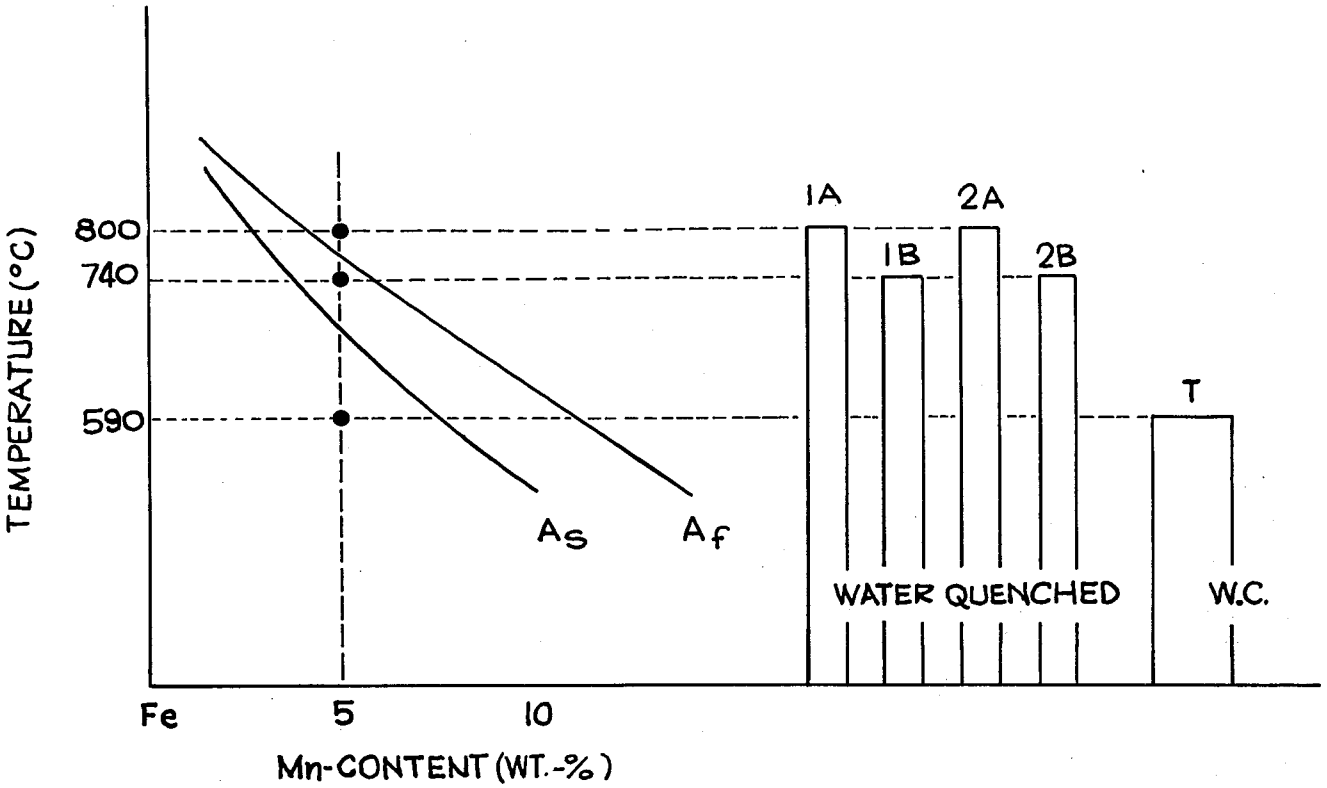
FIG. 1 is a heat treating cycle diagram.
Figure 2:
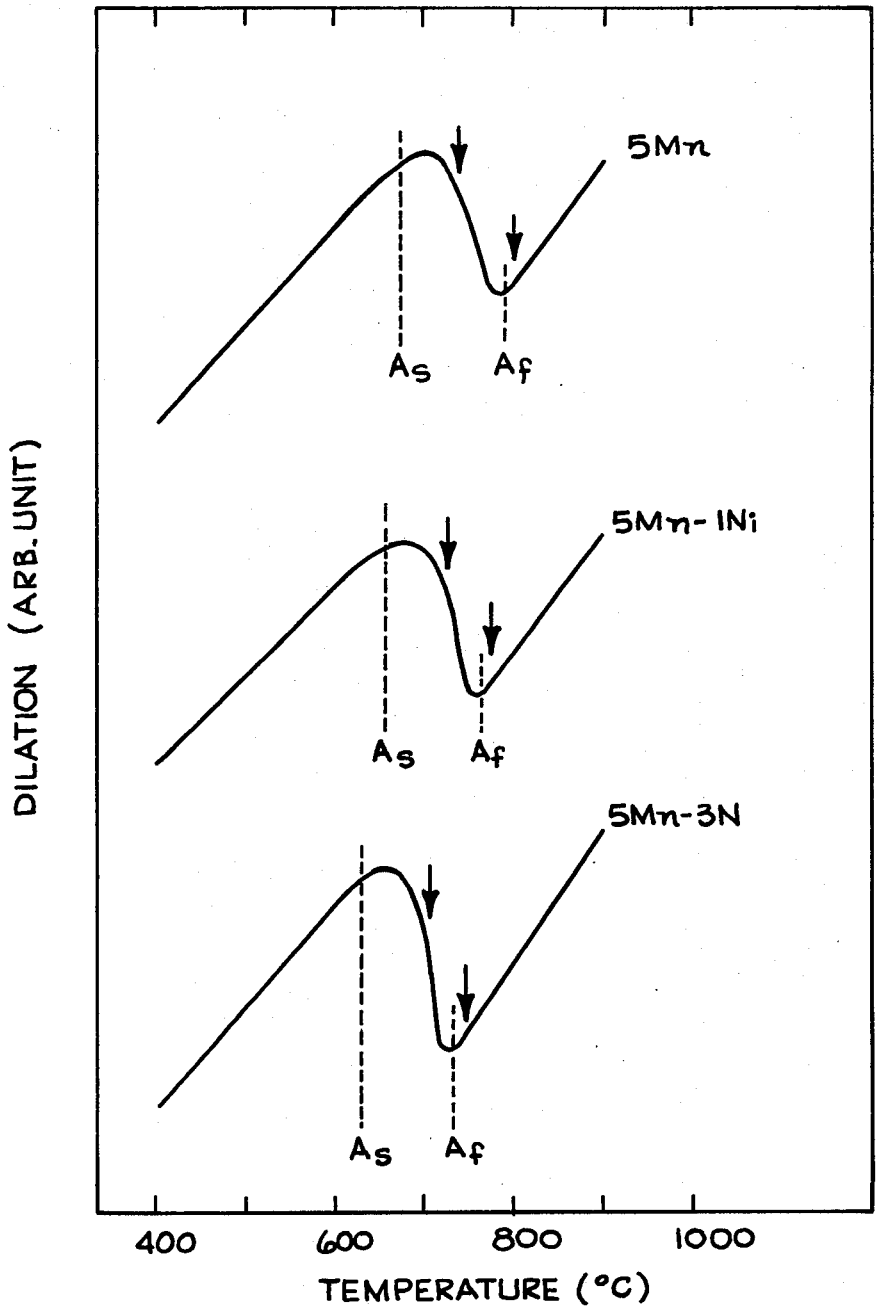
FIG. 2 is a composite graph illustrating the selection of annealing temperatures from dilatomeric data.

A method for selecting the annealing temperatures used in steps 1A, 1B, 2A, and 2B from dilatometric data which indicate the phase transformation temperatures of the alloy on heating is illustrated graphically in FIG. 2. Two reference temperatures are indicated graphically in FIG. 1 and in FIG. 2: (1) a temperature designated $A_s$, which is the approximate temperature at which an alloy initially having the low-temperature alpha structure first begins to undergo two-phase decomposition through partial formation of the high temperature gamma structure on heating, and (2) a second higher temperature designated $A_f$ above which the sample is austenitized in the sense that the transformation from the alpha structure to the gamma structure is essentially completed on heating. These reference temperatures will vary with the rate at which the alloy is heated but such variation is small for the range of heating rates of interest in processing alloys of this type (from about 20° C./min to about 300° C./min).

The variation of the reference temperatures, $A_s$ and $A_f$, with composition, i.e. with changes in manganese content, is illustrated in FIG. 1 and is small for minor change in manganese content. The variation of the reference temperatures with regard to adding 1-3% nickel to the base composition is illustrated in FIG. 2 and is significant.

Based on FIGS. 1 and 2, the temperature for the first anneal (designated 1A) is chosen to be slightly (about 40° C.) greater than the temperature $A_f$. The temperature for the second anneal (designated 1B) is chosen to be less than the temperature $A_f$. Good properties are obtained if the second-anneal temperature is taken to lie approximately mid-way between the reference temperatures $A_s$ and $A_f$. The temperature for the third anneal (designated 2A) is chosen to be slightly above $A_f$, and is, in practice, usually chosen to be slightly lower than the temperature of the first anneal. The temperature for the fourth anneal (designated 2B) is chosen so as to be below the temperature $A_f$. Good properties are obtained if this temperature (step 2B) is identical to the temperature of the second anneal, approximately midway between the reference temperatures $A_s$ and $A_f$.

The "final" tempering treatment (designated T or t), which is subsequent to the thermal cycling, introduces a small admixture of retained austenite. For the present steel, the preferred tempering conditions are a tempering temperature below about 600° C., preferably about 540°-600° C. and a tempering time of about 3-16 hours.

The atmosphere in contact with material during the different steps can be air. An inert atmosphere is preferred.

The following example is illustrative of the present invention.

EXAMPLE

Figure 3:
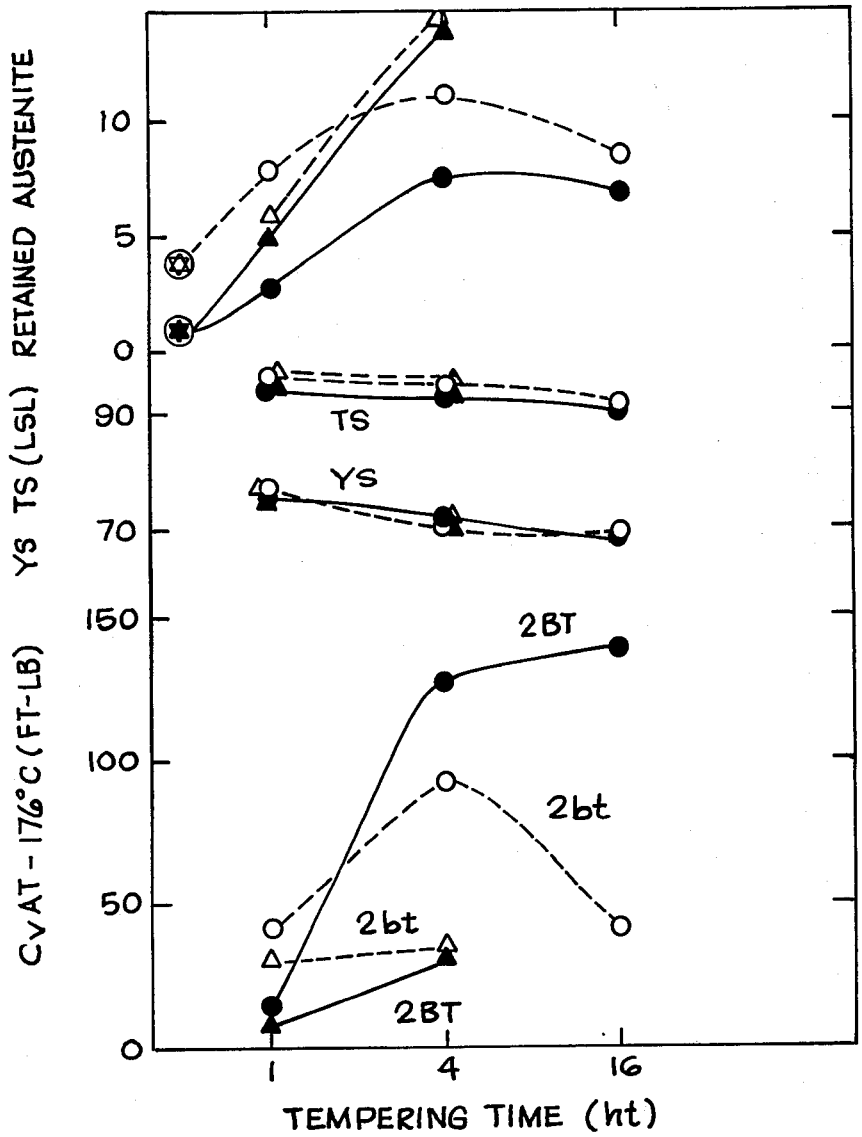
FIG. 3 is a composite graph of Charpy impact energy ($C_V$) as a function of thermal cycling carried out in accordance with the present invention.

A steel having the nominal composition: carbon-0.038%, manganese-4.40%, molybdenum-0.20%, silicon-0.04%, sulfur-0.006%, and the balance iron, was subjected to different heat treatments and the mechanical properties investigated. In FIG. 3, results are shown for Charpy impact energy at −196° C.; yield stress and tensile stress at the room temperature; and the retained austenite as a function of tempering time.

In the cases shown in FIG. 3, the alloy was vacuum induction melted, homogenized at 1200° C. for 24 hours, forged into plate, and then solution annealed at 900° C. for 2 hours followed by air cooling before thermal cycling treatment. For this alloy $A_s$ is about 700° C. and $A_f$ is about 790° C. The specific thermal cycling treatment used consisted of, in sequence, a 1 hour anneal (1A) at 820° C., a water quench, a 1 hour anneal (1B) at 740° C., a water quench, a 1 hour anneal (2A) at 800° C., a water quench, a 1 hour anneal at either 740° C. (2B) or 710° C. (*2b*), a water quench, and a final tempering at 620° C. (t) or 590° C. (T) for 1-16 hours, followed by a water quench.

As seen in FIG. 3, a very promising combination of toughness ($C_V$) at −196° C. and room temperature strength was obtained by the heat treatment designated 2 Bt and the use of a long tempering time (about 4-16 hours).

TEM (transmission electron microscopy) observation showed that the treatment yields an ultra-fine-grained microstructure which consists of ultra-fine well-recovered equiaxed ferrite (grain size about 0.5-1.0 micron) with a precipitated gamma phase at the ferrite grain boundaries and finite or martensite lath boundaries.

Figure 4:
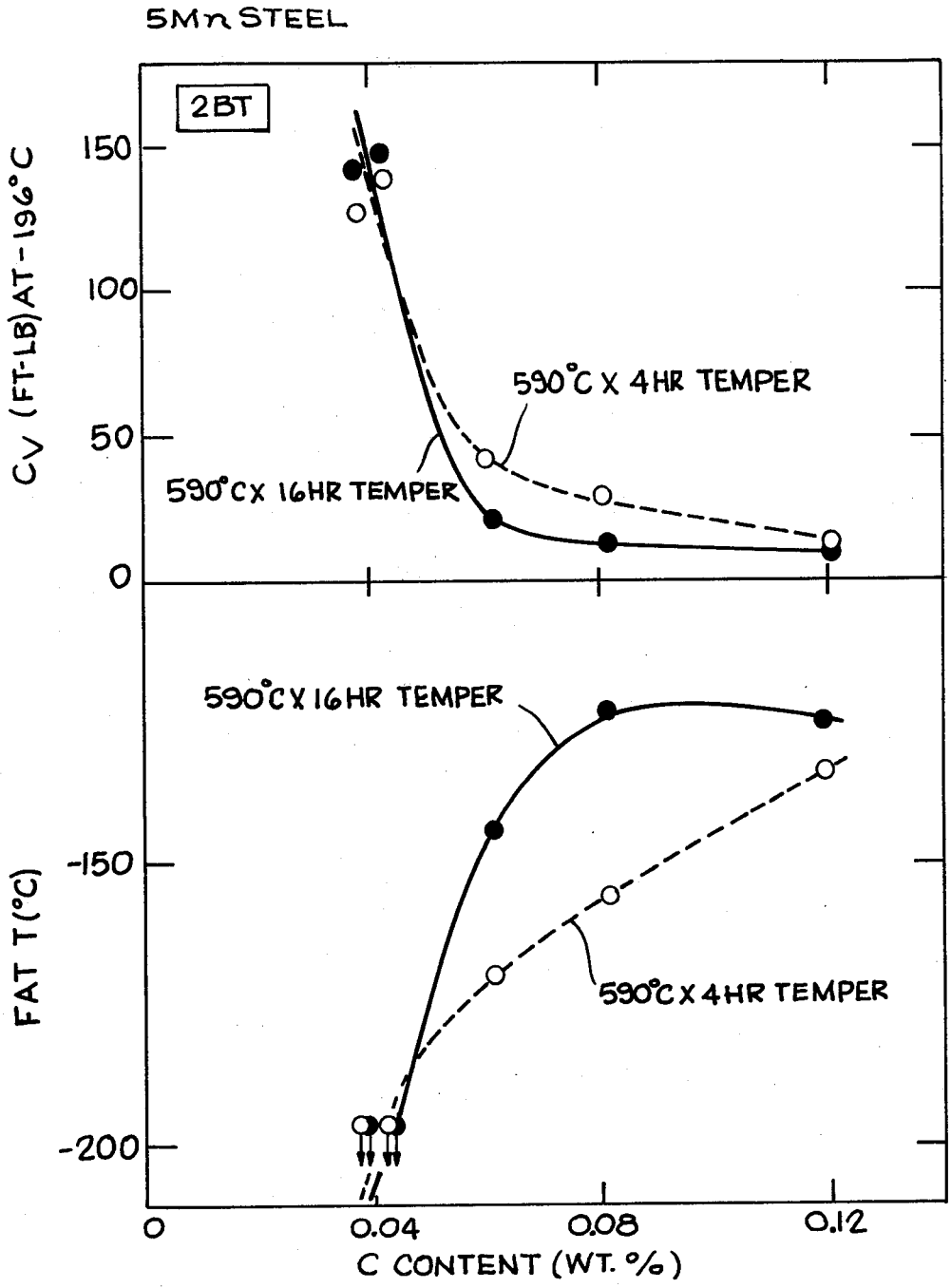
FIG. 4 is a composite graph of the Charpy impact ($C_V$) at 77° K. (−196° C.) and the fracture appearance transition temperature (FATT) as a function of carbon content for alloys of the present invention.

The effect of carbon content on the properties of the alloy after the thermal treatment 2BT was also investigated. The results are illustrated in FIG. 4; the Charpy impact energy ($C_v$) and the fracture appearance transition temperature (FATT) are plotted as a function of carbon content for two final tempering times, 4 hours and 16 hours. The properties of the alloy deteriorate if the carbon content is higher than about 0.06 percent by weight. Carbon contents near 0.04 yield good properties.

Figure 5:
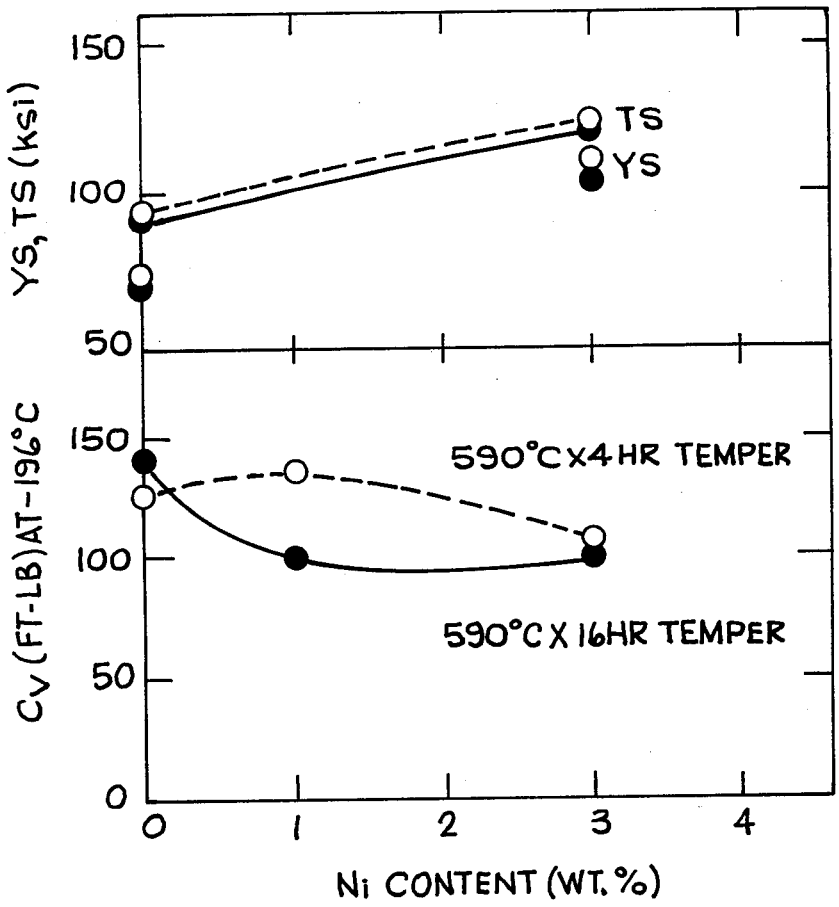
FIG. 5 is a composite graph showing the yield strength (YS), tensile strength (TS), and the Charpy impact energy ($C_V$) as a function of nickel content for alloys of the present invention.

The effect of adding nickel to the base composition was also investigated. The alloys used had nominal composition (in weight percent) manganese 5.0%, molybdenum 0.2%, carbon 0.06%, silicon 0.04%, sulfur 0.006%, balance iron, with an addition of 0%, 1%, or 3% nickel. The alloys were given the thermal cycling treatment described above, with the difference that for these nickel-bearing alloys the annealing temperatures for steps 1A, 1B, 2A, and 2B were changed as shown graphically by the arrows in FIG. 2. The resulting mechanical properties: yield strength (YS) at room temperature, tensile strength (TS) at room temperature, and Charpy impact energy ($C_V$) at 77° K. (−196° C.) are shown graphically in FIG. 5. The room temperature yield strength was found to increase with nickel content while the Charpy impact toughness at 77° K. remained high. In the case of a 3% nickel addition the room temperature yield strength was 110 ksi while the Charpy impact energy at 77° K. was 160 joules (120 ft-lb).

We claim:

1. A cryogenic alloy steel having a composition which is essentially free of nickel consisting essentially of about 4–6% manganese, about 0.02–0.06% carbon, 0.1–0.4% molybdenum, and the balance iron and incidental impurities associated therewith, said steel being characterized by a ductile-brittle transition temperature below −196° C. and a Charpy V-notch impact energy value greater than about 67 joules at −196° C.

2. The steel according to claim 1 wherein favorable cryogenic characteristics are achieved by subjecting said composition to a thermal cycling treatment consisting essentially of a repeated alternation of austenitization and (alpha + gamma) two phase decomposition and a subsequent tempering treatment at a temperature below about 600° C. for about 3–16 hours.

3. A method of imparting favorable cryogenic properties to an alloy steel comprising the steps of:

a. forming a composition which is essentially free of nickel consisting essentially of about 4–6% manganese, about 0.02–0.06% carbon, 0.1–0.4% molybdenum, and the balance iron and incidental impurities associated therewith;

b. a first heating of the composition from a temperature, which is below the characteristic temperature $A_s$ at which the composition, initially having the low-temperature alpha structure, first begins to undergo two-phase decomposition through partial formation of the high temperature gamma structure, to a temperature, which is above the characteristic temperature $A_f$ above which the composition is austenitized in the sense that the transformation from the alpha structure to the gamma structure is essentially completed on heating;

c. a first cooling of the composition to a temperature below $A_s$;

d. a second heating of the composition to a temperature above $A_s$ and below $A_f$;

e. a second cooling of the composition to a temperature below $A_s$;

f. a third heating of the composition to a temperature above $A_f$;

g. a third cooling of the composition to a temperature below $A_s$;

h. a fourth heating of the composition to a temperature above $A_s$ and below $A_f$;

i. a fourth cooling of the composition to a temperature above $A_s$; and f. a tempering of the composition at a temperature below $A_s$.

4. The method according to claim 3 wherein the temperature to which the composition is cooled in the first cooling is about room temperature.

5. The method according to claim 3 wherein the temperature to which the composition is cooled in the second cooling is about room temperature.

6. The method according to claim 3 wherein the temperature to which the composition is heated in the first heating is within about 40° C. of $A_f$.

7. The method according to claim 3 wherein the temperature to which the composition is heated in the second heating is about midway between $A_s$ and $A_f$.

8. The method according to claim 3 wherein the tempering is at a temperature between about 540° C. and 600° C. and for a period between about 3 and 15 hours.

* * * * *